US008975219B2

(12) United States Patent
Scartozzi et al.

(10) Patent No.: US 8,975,219 B2
(45) Date of Patent: Mar. 10, 2015

(54) FABRIC CLEANING COMPOSITION COMPRISING HUEING AGENT

(75) Inventors: Margherita Scartozzi, Pomezia (IT); Luca Sarcinelli, Cerveteri (IT); Sophie Anne Marguerite Goellner, Croissy-sur-Seine (FR); Enza Ceccobelli, Rome (IT); Leo Gagliardi, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 37 days.

(21) Appl. No.: 13/472,526

(22) Filed: May 16, 2012

(65) Prior Publication Data

US 2013/0305461 A1 Nov. 21, 2013

(30) Foreign Application Priority Data

May 18, 2011 (EP) ..... 11166486

(51) Int. Cl.

| | |
|---|---|
| ***C11D 7/32*** | (2006.01) |
| ***C11D 7/34*** | (2006.01) |
| ***C11D 7/54*** | (2006.01) |
| ***C11D 3/30*** | (2006.01) |
| ***D06L 3/02*** | (2006.01) |
| ***C11D 3/34*** | (2006.01) |
| ***C11D 3/42*** | (2006.01) |
| ***C11D 3/40*** | (2006.01) |

(52) U.S. Cl.

CPC . *C11D 3/30* (2013.01); *D06L 3/023* (2013.01); *C11D 3/3481* (2013.01); *C11D 3/349* (2013.01); *C11D 7/3209* (2013.01); *C11D 3/42* (2013.01); *C11D 7/34* (2013.01); *C11D 3/40* (2013.01)

USPC ..... 510/303; 540/309; 540/310; 540/336; 540/337; 540/372; 540/499; 540/492; 540/500; 8/111; 8/137; 8/639; 8/641

(58) Field of Classification Search

CPC ..... C11D 3/30; C11D 3/3481; C11D 3/349; C11D 3/40; C11D 3/42; C11D 7/3209; C11D 7/34; D06L 1/04; D06L 3/021; D06L 3/023

USPC ..... 510/303, 309, 310, 336, 337, 372, 499, 510/500, 492; 8/639, 641, 111, 137

See application file for complete search history.

(56) References Cited

U.S. PATENT DOCUMENTS

2008/0051309 A1 * 2/2008 Lin et al. ..... 510/341

FOREIGN PATENT DOCUMENTS

| | | | |
|---|---|---|---|
| EP | 10 065 264 | A1 | 1/2001 |
| WO | WO 2006/055788 | A1 | 5/2006 |
| WO | WO 2011/017719 | A2 | 2/2011 |

* cited by examiner

*Primary Examiner* — Gregory R Delcotto

(74) *Attorney, Agent, or Firm* — Gregory S. Darley-Emerson; Steven W. Miller

(57) ABSTRACT

A fabric cleaning composition comprising from 1% to 20% by weight of the fabric cleaning composition of an oxygen-based bleaching source and a hueing agent, and wherein the neat composition has a pH between 2.5 and 5.5, and a method of using said fabric cleaning composition.

7 Claims, No Drawings

FABRIC CLEANING COMPOSITION COMPRISING HUEING AGENT

FIELD OF THE INVENTION

The present invention is to fabric cleaning compositions comprising an oxygen-based bleach source and a hueing agent.

BACKGROUND

Fabric cleaning compositions comprising an oxygen-based bleach source are well known in the art. Oxygen-based bleach sources are often used as they provide excellent cleaning of stains from fabrics.

Hueing agents are also well known in the art. Over time, fabrics tend to yellow or become grey. This is due to soils present in the wash liquor (having been removed from stains on the fabrics), re-depositing onto the fabric surface. Hueing agents are a class of organic compounds which are used to improve the whiteness of fabrics following the wash process. They are characterised by having a peak adsorption wavelength such that they can deliver a blue or violet shade on white fabrics, making them appear brighter. This alleviation of the yellowing or graying of fabrics is often called fabric whitening or shading.

Thus, there is a continuing need in the art for a composition that provides the excellent cleaning benefits associated with the presence of an oxygen-based bleach source and the excellent fabric whiteness benefits associated with the presence of a hueing agent.

Many hueing agents are not stable in liquid products comprising oxygen-based bleach sources. The hueing agent tends to break-down or decompose in the cleaning composition over time. Furthermore, there is a distinctive change in colour of the composition due to the loss in concentration of the hueing agent (hueing agents have a distinctive blue or violet colouration). Lastly, the loss in concentration of the hueing agent over time results in a decrease in performance of the composition.

It was surprisingly found that hueing agents present in oxygen-based bleach source comprising compositions wherein the composition has a specific pH of between 2.5 and 5.5 were stable.

These compositions allowed for the dual benefit of both the oxygen based bleach source and the hueing agent.

SUMMARY OF THE INVENTION

A first aspect of the present invention is a fabric cleaning composition comprising from 1% to 20% by weight of the fabric cleaning composition of an oxygen-based bleach source and a hueing agent, and wherein the neat composition has a pH of from 2.5 to 5.5.

Another aspect of the present invention is a method of cleaning fabrics comprising the steps of a) Placing the fabrics in the drum of an automatic washing machine;

b) Adding the cleaning composition to the fabrics in the washing machine;

c) Washing the fabrics in the automatic washing machine.

Another aspect of the present invention is a method of hand washing fabrics comprising the steps of;

a) Preparing a wash liquor comprising water and the composition of the present invention;

b) Adding fabrics to the wash liquor;

c) Cleaning the fabrics by hand in the wash liquor.

DETAILED DESCRIPTION OF THE INVENTION

Hueing Agent

The fabric cleaning composition of the present invention comprises a hueing agent. "Hueing agents" are compounds that deliver observable whiteness to fabrics following the wash process. They are characterised by having an adsorption wavelength such that they can deliver a blue or violet shade on white fabrics, making them appear brighter. Preferably, hueing agents are hydrophobic organic compounds, more preferably, hueing agents are hydrophobic organic compounds which are devoid of polar solubilising groups.

Preferably, the hueing agent exhibits an absorbance spectrum value from 520 nm to 640 nm in water, more preferably from 570 nm to 610 nm in water. In another embodiment, the hueing agent exhibits an absorbance spectrum value from 400 nm to 480 nm.

In one embodiment, the hueing agent is selected from the group comprising Azo dyes, Diazo dyes, or mixtures thereof. In another embodiment, the hueing agent is a Thiophene Azo dye. In one embodiment, the Thiophene Azo dye has the following structure:

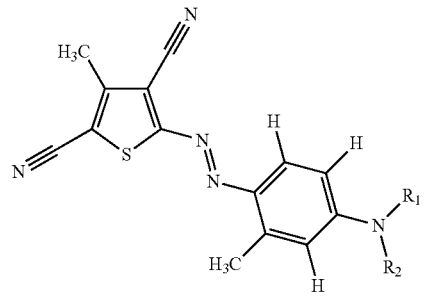

Wherein $R_1$ and $R_2$ can independently be selected from:

a) $[(CH_2CR'HO)_x(CH_2CR''HO)_yH]$ wherein R' is selected from the group consisting of H, $CH_3$, $CH_2—O—(CH_2CH_2O)_zH$, and mixtures thereof; wherein R" is selected from the group consisting of H, $CH_2O(CH_2CH_2O)_zH$, and mixtures thereof; wherein $x+y\leq5$; wherein $y\geq1$; and wherein $z=0$ to 5;

b) $R_1$=alkyl, aryl or aryl alkyl and $R_2=[(CH_2CR'HO)_x(CH_2CR''HO)_yH]$ wherein R' is selected from the group consisting of H, $CH_3$, $CH_2—O—(CH_2CH_2O)_zH$, and mixtures thereof; wherein R" is selected from the group consisting of H, $CH_2—O—(CH_2CH_2O)_zH$, and mixtures thereof; wherein $x+y\leq10$; wherein $y\geq1$; and wherein $z=0$ to 5;

c) $R_1=[CH_2CH(OR_3)CH_2OR_4]$ and $R_2=[CH_2CH(OR_3)CH_2OR_4]$ wherein $R_3$ is selected from the group consisting of H, $(CH_2CH_2O)_nH$, and mixtures thereof; and wherein $z=0$ to 10;

wherein $R_4$ is selected from the group consisting of $(C_1\text{-}C_{16})$alkyl, aryl groups, and mixtures thereof; and d) wherein R1 and R2 can independently be selected from the amino addition product of styrene oxide, glycidyl methyl ether, isobutyl glycidyl ether, isopropylglycidyl ether, t-butyl glycidyl ether, 2-ethylhexylgycidyl ether, and glycidylhexadecyl ether, followed by the addition of from 1 to 10 alkylene oxide units.

Preferably, the Thiophene Azo Dye has the following formula:

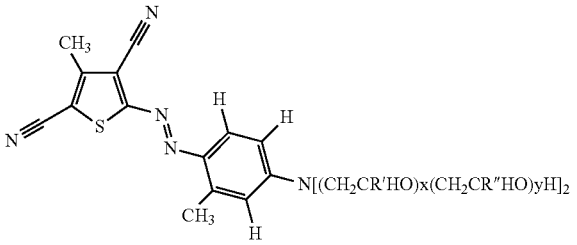

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein $x+y\leq5$; wherein $y\geq1$; and wherein z=0 to 5. It should be noted that there are two $[CH_2CR'HO)_x(CH_2CR''HO)_yH]$ groups. In one embodiment, these groups are identical. In another embodiment, these groups are different.

It was surprisingly found that a further benefit of Thiophene Azo dyes having the formula shown above was that they provided improved consumer-noticeable whiteness of fabrics following a single wash cycle as compared to other hueing agents.

Hueing agents sometimes build up on the fabrics following multiple cycles, leading to a too intense fabric whitening over repeated washes. It was also surprisingly found, that the Thiophene Azo dyes having the formula shown above exhibited reduced build-up on fabrics following multiple cycles as compared to other hueing agents.

Preferably, the hueing agent is present at a concentration of between 0.000001% and 3.25% by weight of the fabric cleaning composition, more preferably, between 0.000005% and 0.65%, and most preferably between 0.00005% and 0.065%. It was found that the hueing dye was most effective at fabric whitening at these concentrations.

Oxygen-Based Bleach Source

The fabric cleaning compositions of the present invention comprise an oxygen-based bleach source. Preferably, the oxygen-based bleach source is selected from the group comprising hydrogen peroxide, peracids, aliphatic or aromatic diacyl peroxide, or mixtures thereof. In one embodiment, the oxygen-based bleach source is hydrogen peroxide.

In another embodiment, the oxygen based bleach source is a peroxy carboxylic acid (hereafter referred to as peracid). Preferred peracids are those having the general formula:

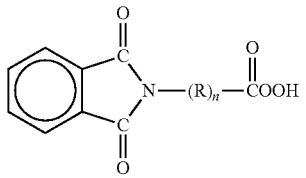

wherein R is selected from $C_{1-4}$ alkyl and n is an integer of from 1 to 5.

In a particularly preferred aspect of the present invention the peracid has the formula such that R is $CH_2$ and n is 5, this compound being referred to as phthaloyl amino-peroxy caproic acid or PAP. The peracid is preferably used as a substantially water-insoluble solid compound and is available from Solvay/Ausimont under the tradename Euroco®.

In another embodiment, the oxygen-based bleach source is phthaloyl amino-peroxy caproic acid.

In another embodiment, the oxygen-based bleach source is an aliphatic or aromatic Diacyl Peroxide, more preferably an aliphatic or aromatic Diacyl Peroxide having chainlength between C6 and C18. In a preferred embodiment, the Diacyl Peroxide is Dilauroyl Peroxide.

The compositions of the present invention comprise from 1% to 20%, preferably from 1.5% to 18% and more preferably from 3% to 15%, by weight of the composition, of an oxygen-based bleach source.

pH

The term "pH", as used herein, is defined as the pH of the neat composition. The 'neat' composition is the composition before it is diluted, for example in the wash liquor of the washing machine.

The neat pH of the fabric cleaning composition is between 2.5 and 5.5. Preferably, the neat pH of the fabric cleaning composition is between 3 and 5. It was surprisingly found that within this specific pH range, the hueing agent is stable in the presence of the oxygen-based bleach source. Without being bound by theory, it is believed that the stability is in at least part due to the protonation of labile groups of the hueing agent. Protonated labile groups are sacrificially oxidized by the oxygen based bleach source, in preference to other parts of the hueing dye. Oxidation of the labile groups does not affect whiteness benefit. At a neat pH of above 5.5, the labile groups are not sufficiently protonated. At a neat pH of less than 2.5, the oxygen-based bleach source is not stable, as a result of an acid-catalyzed decomposition reaction.

The neat pH of the fabric cleaning composition can be measured using any known techniques. Those skilled in the art would know how to measure the pH of the fabric cleaning compositions. In one embodiment, the pH is measured using a "Metrohm 827 pH lab" pH meter with electrode 6.0228.010, calibrated in the pH range from 2.0 to 7.0, at a temperature of 20° C.

The pH of the fabric cleaning composition can be adjusted using any organic or inorganic acid or alkali, preferably sulfuric acid and sodium hydroxide. Those skilled in the art would know how to accomplish this.

Bleach Activators

In one embodiment the fabric care composition of the present invention comprises a bleach activator. Bleach activators boost the cleaning power of the oxygen-based bleaching agent via a perhydrolysis reaction brought about by nucleophilic attack on the bleach activator by a perhydroxide anion.

In a preferred embodiment, the bleach activator used has the general formula:

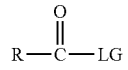

wherein R is an alkyl group, linear or branched, containing from about 1 to 11 carbon atoms and LG is a suitable leaving group. As used herein, a "leaving group" is any group that is displaced from the bleach activator as consequence of nucleophilic attack on the bleach activator by the perhydroxide anion, i.e. perhydrolysis reaction.

Generally, a suitable leaving group is electrophilic and is stable such that the rate of the reverse reaction is negligible.

This facilitates the nucleophilic attack by the perhydroxide anion. The leaving group must also be sufficiently reactive for the reaction to occur within the optimum time frame, for example during the wash cycle. However, if the leaving group is too reactive, the bleach activator will be difficult to stabilize. These characteristics are generally paralleled by the pKa of the conjugate acid of the leaving group, although exceptions to this convention are known. The conjugate acid of the leaving group in accordance with the present invention preferably has a pKa in a range from about 4 to about 13, more preferably from about 6 to about 11, and most preferably from about 8 to about 11.

Preferably, the leaving group has the formula:

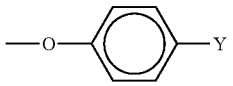

wherein Y is selected from the group consisting of $SO_3^-M^+$, $COO^-M^+$, $SO_4^-M^+$, $PO_4^-M^+$, $PO_3^-M^+$. $(N^+R^2_3)X^-$ and $O\leftarrow N(R^2_2)$, M is a cation and X is an anion, both of which provide solubility to the bleach activator, and $R^2$ is an alkyl chain containing from about 1 to about 4 carbon atoms or H. In accordance with the present invention, M is preferably an alkali metal, with sodium being most preferred. Preferably, X is a hydroxide, methylsulfate or acetate anion.

Other suitable leaving groups have the following formulae;

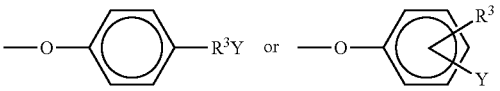

wherein Y is the same as described above and $R^3$ is an alkyl chain containing from about 1 to about 8 carbon atoms, H or $R^2$.

While numerous bleach activators as described above are suitable for use in the present invention, a preferred bleach activator has the formula:

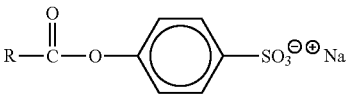

wherein R is an alkyl chain, linear or branched, containing from 1 to 11 carbon atoms. More preferably, R is an alkyl chain, linear or branched, containing from 3 to 11, even more preferably from 8 to 11.

Most preferably, according to the present invention, the bleach activator has the formula:

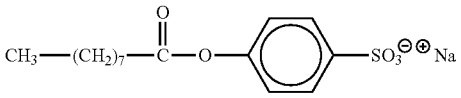

which is also referred to as sodium n-nonyloxybenzene sulfonate (hereinafter referred to as "NOBS").

The compositions of the present invention comprise from 1% to 40%, preferably from 2% to 30% and more preferably from 3% to 20%, by weight of the fabric cleaning composition of a bleach activator.

In one embodiment, the bleach activator can be a mixture of bleach activators. Preferred mixtures of bleach activators herein comprise n-nonanoyloxybenzene-sulphonate (NOBS) together with a second bleach activator having a low tendency to generate diacyl peroxide, but which delivers mainly peracid.

A second bleach activator may include one selected from the group comprising tetracetyl ethylene diamine (TAED), acetyl triethyl citrate (ATC), acetyl caprolactam (ACL), benzoyl caprolactam (BCL) and the like, or mixtures thereof. Indeed, it has been found that mixtures of bleach activators comprising n-nonanoyloxybenzene-sulphonate and a second bleach activator, contribute to further boost particulate soil removal performance while exhibiting at the same time good performance on diacyl peroxide sensitive soil (e.g., beta-carotene) and on peracid sensitive soil (e.g., body soils).

Adjunct Materials

The bleaching compositions herein may further comprise other optional ingredients such as: surfactants, enzymes, fillers, chelating agents, radical scavengers, antioxidants, stabilizers, builders, soil suspending polymer, polymeric soil release agents, dye transfer inhibitor, solvents, suds controlling agents, suds booster, brighteners, perfumes, pigments, perfume microcapsules, dyes and the like.

Product Forms

The compositions of the present invention can be in any suitable flowable form in which the pH of the composition can be measured. In a preferred embodiment, the fabric cleaning compositions of the present invention are in a form selected from the group comprising liquid, gel or paste. An advantage of these forms is that it allows consumers to easily dose the product and pretreat, and to allow a quick and uniform dissolution of the active ingredients in the wash. Preferably, the compositions of the present invention are liquid.

Method of Use

Another aspect of the present invention is a method of cleaning fabrics comprising the steps of a) Placing the fabrics in the drum of an automatic washing machine;
b) Adding the cleaning composition to the fabrics in the washing machine;
c) Washing the fabrics in the automatic washing machine.

Another aspect of the present invention is a method hand washing fabrics comprising the steps of;

d) Preparing a wash liquor comprising water and the composition of the present invention;
e) Adding fabrics to the wash liquor;
f) Cleaning the fabrics by hand in the wash liquor.

In another embodiment, the fabrics are first pre-treated with the cleaning composition prior to being put into the washing machine or hand washed. Pre-treatment ensures efficient contact of the stain with the cleaning composition. This can improve the ability of the cleaning composition to remove the stain. Fabrics can be treated or pre-treated in any number of ways. For example, the fabric cleaning composition can be poured directly onto the fabric then the fabric can be scrubbed or rubbed before being transferred into the washing machine or hand washed.

EXAMPLES

Whitening Ability

The ability of the hueing agent to improve whiteness of fabrics following four wash cycles was tested. A number of fabrics comprising stains or soils were collected. For each different fabric, 16 replicates were prepared. Each replicate was then cut into two pieces, such that for each fabric type there were 32 pieces of fabric in total. Fabrics were labeled 1A-16A and 1B-16B. Therefore 1A is a direct comparison to 1B and 2A is a direct comparison to 2B etc. Each of the replicates were then washed four times using different cleaning compositions.

The first set of 16 replicate fabrics were washed using commercially available Dash Actylift powder at the on-pack recommended dosage and 60 ml of test product A (Table 1). The second set of 16 replicate fabrics were washed using commercially available Dash Actylift powder at the on-pack recommended dosage and 60 ml of test product B (Table 1). All fabric wash cycles were done at 30° C. in an Ariston automatic fabric washing machine.

TABLE 1

| Ingredient | product A (% w/w) | product B (% w/w) |
|---|---|---|
| Linear alkylbenzene sulphonate | 6.15 | 6.15 |
| Marlipal 24.7 | 9.30 | 9.30 |
| Marlipal 24-3 | 2.70 | 2.70 |
| Hydrogen Peroxide | 7.00 | 7.00 |
| hexamethylenediamine EO24 dimethyl quat, disulfonated | 2.50 | 2.50 |
| HEDP acid | 0.50 | 0.50 |
| Brightener 49 | 0.15 | 0.15 |
| NaOH | 0.98 | 0.98 |
| perfume | 0.16 | 0.16 |
| Tinagard NOA | 0.03 | 0.03 |
| Thiophene Azo dye | — | 0.02 |
| Acid Blue 80 | 0.002 | — |

TABLE 1-continued

| Ingredient | product A (% w/w) | product B (% w/w) |
|---|---|---|
| $Na_2SO_4$ | 0.45 | 0.45 |
| DI water | 70.08 | 70.08 |

The pH of the neat compositions was 3

Corresponding fabrics washed with test product A were visually compared by three independent judges to those washed with test product B. The number of replicate fabrics washed with A that looked whiter than B were counted and the number of B that looked whiter than A were counted and percentage difference calculated. So for example of the 16 replicates, if 1A-4A were whiter than 1B-4B but 5B-16B were whiter than 5A-16A, then 25% A were whiter but 75% B were whiter. Results can be seen in Table 2.

TABLE 2

| Item | % Preference % A | % Preference % B |
|---|---|---|
| SHIRT | 36 | 64 |
| SOCKS | 41 | 59 |
| T-SHIRT | 0 | 100 |
| TERRY TOWELS | 10 | 90 |
| PILLOW CASES | 38 | 63 |
| COLLARS | 32 | 68 |
| FOOD | | |
| TEA TOWELS | 32 | 68 |

As can be seen from Table 2, fabrics washed with test product B, comprising a thiozene azo dye showed improved whiteness following 4 washes as compared to fabrics washed with test product A, not comprising a thiophene azo dye.

Hueing Agent Stability

The following compositions were prepared (Table 3) in which the pH was adjusted. Compositions 1-7 were according to the present invention and comparative composition was outside of the present invention.

TABLE 3

| Ingredient | Comparative | 1 | 2 | 3 | 4 | 5 | 6 | 7 |
|---|---|---|---|---|---|---|---|---|
| Linear alkylbenzene sulphonate | 6.15 | 6.15 | 6.15 | 6.15 | 6.15 | 6.15 | 6.15 | 6.15 |
| Marlipal 24.7 | 9.30 | 9.30 | 9.30 | 9.30 | 9.30 | 9.30 | 9.30 | 9.30 |
| Marlipal 24-3 | 2.70 | 2.70 | 2.70 | 2.70 | 2.70 | 2.70 | 2.70 | 2.70 |
| Hydrogen Peroxide | 7.00 | 7.00 | 7.00 | 7.00 | 7.00 | 7.00 | 7.00 | 7.00 |
| hexamethylenediamine EO24 dimethyl quat, disulfonated | 2.50 | 2.50 | 2.50 | 2.50 | 2.50 | 2.50 | 2.50 | 2.50 |
| HEDP acid | 0.50 | 0.50 | 0.50 | 0.50 | 0.50 | 0.50 | 0.50 | 0.50 |
| Brightener #49 | 0.15 | 0.15 | 0.15 | 0.15 | 0.15 | 0.15 | 0.15 | 0.15 |
| Perfume | 0.16 | 0.16 | 0.16 | 0.16 | 0.16 | 0.16 | 0.16 | 0.16 |
| Tinagard NOA | 0.03 | 0.03 | 0.03 | 0.03 | 0.03 | 0.03 | 0.03 | 0.03 |
| Thiophene azo dye | 0.03 | 0.03 | 0.03 | 0.03 | 0.03 | 0.03 | 0.03 | 0.03 |
| $Na_2SO_4$ | 0.45 | 0.45 | 0.45 | 0.45 | 0.45 | 0.45 | 0.45 | 0.45 |
| DI water | 70.08 | 70.08 | 70.08 | 70.08 | 70.08 | 70.08 | 70.08 | 70.08 |
| NaOH (To adjust pH) | To pH 2.0 | To pH 2.5 | To pH 3.0 | To pH 3.5 | To pH 4.0 | To pH 4.5 | To pH 5.0 | To pH 5.5 |

% by weight of the composition

The compositions were measured using a spectrophotometer at 582 nm wavelength. The value obtained corresponded to 0.03% by weight of the composition of thiophene azo dye. The products were then placed in a 50° C. oven for 15 days to simulate aging of the product. The aging simulates an amount of time for which a product could be expected to be stored prior to use by a consumer. Following 15 days at 50° C. the level of dye was again measured using a spectrophotometer at 582 nm wavelength, and the percentage by weight of the composition of thiophene azo dye calculated. From this, the percentage loss in dye was calculated. Dye loss is a measure of instability of the thiophene azo dye in the composition. Results can be seen in Table 4.

TABLE 4

| Composition | pH of composition | % hueing agent in composition | % hueing agent in compostion after aging | % Dye loss |
|---|---|---|---|---|
| Comparative | 2 | 0.029 | 0.011 | 62 |
| 1 | 2.5 | 0.03 | 0.023 | 23 |
| 2 | 3 | 0.03 | 0.027 | 10.00 |
| 3 | 3.5 | 0.03 | 0.028 | 6.5 |
| 4 | 4 | 0.029 | 0.028 | 3.5 |
| 5 | 4.5 | 0.03 | 0.029 | 3 |
| 6 | 5 | 0.03 | 0.027 | 10 |
| 7 | 5.5 | 0.031 | 0.023 | 25 |

Greater than a 25% loss in thiophene azo dye is noticeable by consumers. As can be seen from Table 4, at a pH of 5.5, the percentage thiophene azo dye loss is 25%. A percentage loss greater than this results in a consumer unacceptable product in which there is a clear difference in whiteness seen. Likewise at a pH of 2, dye loss is 62%. Thus, there is a specific pH range in which the thiophene azo dye remains present at a consumer acceptable level.

Examples of compositions according to the present invention can be seen in Table 5.

TABLE 5

| | Example 1 | Example 2 | Example 3 | Example 4 | Example 5 | Example 6 |
|---|---|---|---|---|---|---|
| Hueing agent | 0.01% | 0.01% | 0.01% | 0.01% | 0.01% | 0.01% |
| Hydrogen Peroxide | 7% | | | 5% | 5% | |
| Dilauroyl Peroxide | | 3% | | | 1% | 1% |
| Phthaloyl-aminoperoxycaproic acid | | | 5% | | | 5% |
| sodium n-nonyloxybenzene sulfonate | | | | 2% | | |
| Water and adjunct materials | To 100% | To 100% | To 100% | To 100% | To 100% | To 100% |
| pH | 3 | 3 | 3 | 3 | 3 | 3 |

Percentage by weight of the composition

It was further surprisingly found that among the different chemical classes of hueing agents, Thiophene Azo Dyes combine the optimal whiteness performance in single wash with limited build-up following multiple cycles, as well as being stable in the presence of an oxygen-based bleach source at a pH of between 2.5 and 5.5 of the neat composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric cleaning composition comprising from 3% to 15% by weight of the fabric cleaning composition of an oxygen-based bleaching source, said composition further comprising a hueing agent, wherein the neat composition has a pH between 3 and 5;

wherein the hueing agent is a Thiophene Azo dye, wherein the Thiophene Azo dye has the following formula:

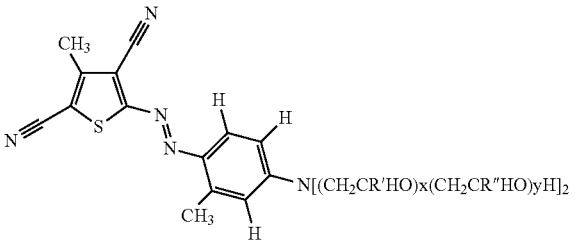

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein $x+y\leq 5$; wherein $y\geq 1$; and wherein z=0 to 5, and where each $[CH_2CR'HO)_x(CH_2CR''HO)_yH]$ can be the same or different;

wherein the oxygen-based bleach source is hydrogen peroxide;

and wherein the hueing agent is present at a concentration of between 0.000001% and 3.25% by weight of the fabric cleaning composition.

2. A method of cleaning fabrics comprising the steps of:

a) Placing the fabrics in the drum of an automatic washing machine;

b) Adding the cleaning composition of claim 1 to the fabrics in the washing machine;

c) Washing the fabrics in the automatic washing machine.

3. A method of hand washing fabrics comprising the steps of:

a) Preparing a wash liquor comprising water and the composition of claim 1;

b) Adding fabrics to the wash liquor;

c) Cleaning the fabrics by hand in the wash liquor.

4. The fabric cleaning composition according to claim 1, wherein each $[CH_2CR'HO)_x(CH_2CR''HO)_yH]$ is different.

5. The fabric cleaning composition according to claim 1, wherein R' is H, and wherein R" is H.

6. The fabric cleaning composition according to claim 1, wherein the hueing agent is present at a concentration of between 0.000005% and 0.65% by weight of the fabric cleaning composition.

7. The fabric cleaning composition according to claim 1, wherein the hueing agent is present at a concentration of between 0.00005% and 0.065% by weight of the fabric cleaning composition.

* * * * *